US005267790A

United States Patent [19]

Sutherland et al.

[11] Patent Number: 5,267,790

[45] Date of Patent: Dec. 7, 1993

[54] TEMPERATURE-CONTROLLED HOMOGENIZER WITH SAMPLE GRIPPER

[75] Inventors: David T. Sutherland, Kingston; Siegfried G. Bart, Jr., Gardiner; Douglas G. Wernerspach, Fishkill; Dean B. Wise, Shokan; Anthony P. Montalbano, Bayville; Christopher T. Montalbano, Great Neck; Douglas J. Hohlbein, Central Islip, all of N.Y.

[73] Assignee: SP Industries Limited Partnership, Miami, Fla.

[21] Appl. No.: 846,835

[22] Filed: Mar. 6, 1992

[51] Int. Cl.[5] ..... B01F 15/06; B01F 7/16; B01F 13/04

[52] U.S. Cl. ..... 366/145; 366/206; 366/207; 366/286; 366/601

[58] Field of Search ..... 73/53, 863; 269/71, 269/73, 95, 81, 210, 265, 274; 366/145, 197, 198, 203, 206, 207, 261, 285, 286, 279, 601; 422/109, 130, 225

[56] References Cited

U.S. PATENT DOCUMENTS

| | | | |
|---|---|---|---|
| 1,064,070 | 6/1913 | Gibbs | 366/207 |
| 2,383,201 | 8/1945 | Krutchten | 269/81 |
| 3,738,637 | 6/1973 | Goldsworthy | 269/71 |
| 4,676,955 | 6/1987 | Berty | 366/316 |
| 5,145,250 | 9/1992 | Planck | 366/139 |

*Primary Examiner*—Harvey C. Hornsby
*Assistant Examiner*—Terrence R. Till
*Attorney, Agent, or Firm*—Heslin & Rothenberg

[57] ABSTRACT

The present invention provides a high speed homogenizer which has an adjustable gripping means to grip and hold containers of varying size. This gripping and holding means can be centered or decentered under the homogenizing tool. Decentering a container held by the gripping and holding means tends to minimize or even eliminate vortexing problems. The homogenizer also has electronic means for controlling the speed and time of operation of the homogenizing tool. The electronic control means of the homogenizer can also monitor the temperature of the sample being homogenized and respond to changes in temperature when necessary. The homogenizer can be easily adjusted up and down a vertical support post by a counter weighting mechanism such as a constant force spring.

14 Claims, 5 Drawing Sheets

64
88
59
87
90
90
89
89
68
91
33

TEMPERATURE-CONTROLLED HOMOGENIZER WITH SAMPLE GRIPPER

FIELD OF THE INVENTION

The present invention relates to a homogenizer with means for gripping and holding containers of material being homogenized. Furthermore, the homogenizer of the present invention has means for holding containers of varying size and means to center or decenter the containers when necessary. The homogenizer of the present invention is equipped to control speed and time of operation, as well as monitor the temperature of the material being homogenized and react to temperature changes in a specified manner.

BACKGROUND ART

Homogenizers have a variety of applications and are extensively used in biological, chemical and pharmaceutical research and laboratory testing. Among the uses in research and testing are homogenizing biological tissue, disrupting cell membranes or walls, dispersing solids or powders in liquids, accelerating chemical reactions and preparing emulsions. Homogenizers also can shred, mix, blend and dissolve materials of various kinds.

Those skilled in the art know a homogenizer is a very sophisticated mixer or blender similar in some functions to a household food mixer or blender. Those skilled in the art also know that a homogenizer usually consist of a base, support post, support bracket, motor and homogenizing tool. The base, support post and support bracket securely hold the motor, shaft and homogenizing tool over the container with the sample to be homogenized. The homogenizing tool is located at the bottom end of a shaft extending down from the motor. The homogenizing tool can be raised or lowered by use of the support bracket. Often, but not always, the container in which the item or items to be homogenized are placed is specially made to work in conjunction with a cover or cap attached to the shaft of the homogenizing tool. Consequently, at the same time the homogenizing tool is lowered into the specially made container, the cap or cover comes in contact with the top edge of the mouth of the container. The container, the homogenizing tool and cap are made and arranged so that the cap presses down onto the top edge of the container to hold it in place and center the homogenizing tool in the center of the container during the process of homogenization.

The homogenizing tool can be an open blade assembly or a rotor located in a cylindrical stator both of which are known in the art. The rotor draws the sample to be homogenized up into an opening in the base of the stator and then ejects the sample out through holes in the curved cylindrical surface of the stator. Open flasks, which can be secured by a bracket, can also be used with the homogenizing tools.

There are several disadvantages with the technology described above. Specially made containers must be used that entail added expense and require the transfer of the item or items to be homogenized to the container. Centering of the container to receive the homogenizing tool must be done by hand. Once the cap is secured to the top of the container and homogenizing tool is placed in the container and fully engaged, there is no way to vary the position of the homogenizing tool in the container. The homogenizing tool, when fully engaged, is at the center of the container. This arrangement can lead to "vortexing," an affect where items are thrown to the side and remain there, in particular fibrous material or solids such as powders, consequently, complete homogenization of the material may not be accomplished. Specially made fluted flasks, known in the art, can be used to help eliminate vortexing.

One way to avoid the problem of vortexing and use a standard laboratory container is for the operator to hold the container with the material to be homogenized during the homogenization process. The operator can control the position of the container by manually moving it and thus avoid the problem created by vortexing.

However, manual control of the position of the container by the operator creates several problems. One problem is an inability to center the container precisely when necessary. An even more serious and deadly problem is exposure of the operator to the substances being homogenized that may be hazardous and life threatening. Manual manipulation of the container during the homogenization process could result in spillage or splattering of the items being homogenized onto the operator.

Another problem with homogenizers currently in use is the risk of destroying temperature sensitive samples, such as DNA, during the homogenization process. The heat generated by the homogenizing tool during the homogenizing process can, in some instances, raise the temperature of the material being homogenized above a safe level and cause degradation or destruction of the sample.

SUMMARY OF THE INVENTION

It is then an object of the present invention to provide a homogenizer able to grip and hold containers of varying size and shape.

It is a further object of the present invention to provide a means for avoiding the problem of vortexing and for centering a container when necessary.

An additional object of the present invention is to provide a convenient and effortless means to adjust the height of the homogenizing unit over the container with the sample to be homogenized.

It is an additional aspect of the present invention to provide electronic control means to control the speed and the duration of operation of the homogenizing tool. An additional object of the present invention is to allow the electronic control means to monitor the temperature of the sample being homogenized and prevent the sample from exceeding a predetermined threshold temperature.

The present invention has a horizontal base, a vertical support post connected to the base and an adjustable bracket attached to the vertical support post. The homogenizing unit has electronic control means and a motor. The homogenizing unit is connected to the support post by the bracket. The support post which is hollow contains a counter weighting mechanism which attaches to the bracket located on the exterior of the vertical post. The counter weighting mechanism, in one version a constant force spring, allows for ease of movement of the homogenizing unit up and down the vertical post. A rotatable homogenizing tool connects to the motor of the homogenizing unit by means of a shaft. A gripping and holding means located on the base beneath the homogenizing unit can be adjusted to hold containers of varying size and shape.

The gripping and holding means is centered under the rotatable homogenizing tool. The rotatable homogenizing tool can be raised up or lowered down into a container held by the gripping and holding means. The position of the gripping and holding means can be changed to allow the container to be either centered or decentered under the rotatable homogenizing tool. "Decentered" means that the central axis of the container is not concentric with the axis of the homogenizing tool.

As noted above, the homogenizer has electronic control means that is used to: a) control the time of operation of the rotatable homogenizing tool, b) control the speed of operation of the rotatable homogenizing tool, and c) monitor the temperature of the sample being homogenized with the capability of ceasing operation if the temperature of the sample exceeds a set temperature. The electronic control means consists of a programmable microprocessor located in the homogenizing unit.

BRIEF DESCRIPTION OF THE DRAWINGS

The foregoing and other objects, features and advantages of the invention will be apparent from the following detailed description of a preferred embodiment of the invention, as illustrated in the accompanying drawings, in which.

BEST MODE FOR CARRYING OUT THE INVENTION

Figure 1:
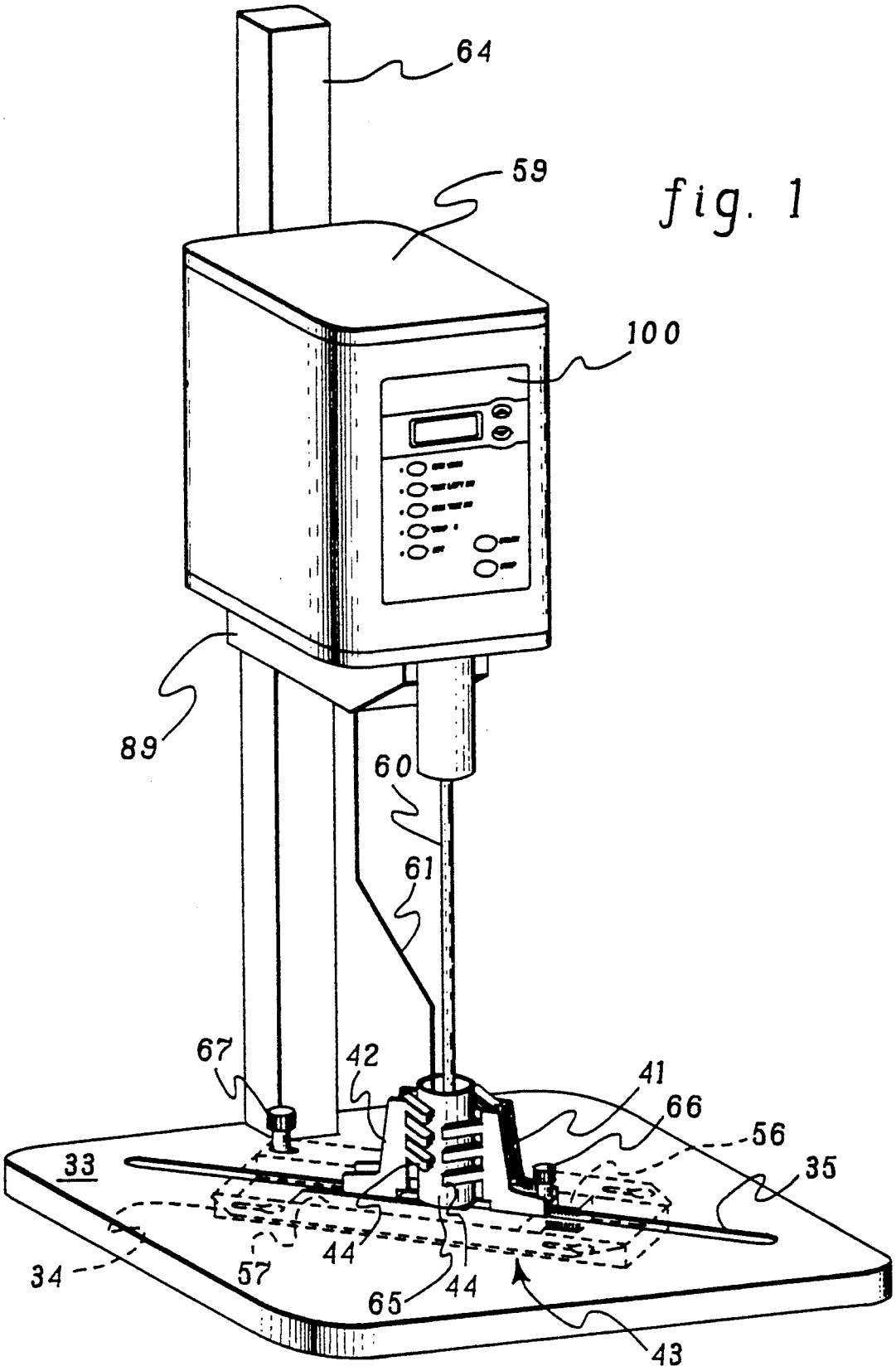
FIG. 1 depicts the homogenizer of the present invention and its major features.

A preferred embodiment of the present invention will now be described. FIG. 1 is a depiction of the preferred embodiment of the present invention. A base plate 33 and support post 64 provide support for a homogenizing unit 59. The homogenizing unit 59 contains an electronic control means and a motor. Electrical power supplied to the homogenizing unit 59 comes through a standard electrical power cord not shown, which plugs into a standard wall outlet. A rotatable shaft with homogenizing tool 60 extends from the homogenizing unit 59 into flask 65 in which material to be homogenized is deposited. The homogenizing unit 59 is connected to post 64 by a bracket 89. The bracket 89, in conjunction with a counterweight mechanism contained in post 64, to be described below, allows unit 59 to be raised or lowered on post 64. Thus, the homogenizing tool 60, attached to the homogenizing unit 59, can be lowered into flask 65 and raised out of flask 65 by use of bracket 89. The motor in the homogenizing unit 59 provides the power to operate the shaft and homogenizing tool 60. Line 61 is a thermocouple line used by the homogenizing unit 59 to monitor the temperature of the material in flask 65 being homogenized. Panel 100 is an electronic control panel for the electronic control means of the homogenizer. This aspect of the invention will be discussed in detail below.

Figure 6:
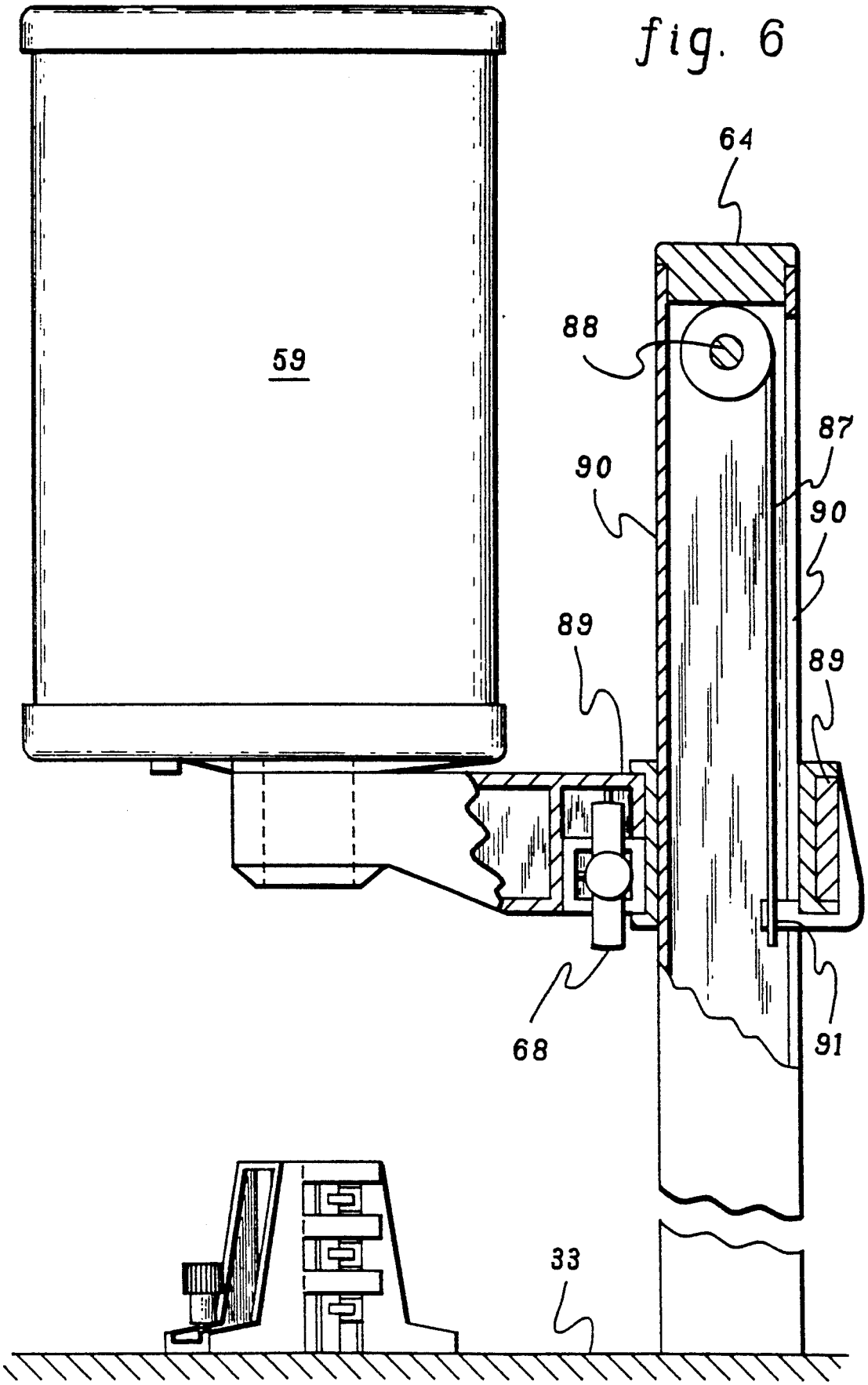
FIG. 6 is an elevational view of one side of the homogenizer with a portion of one side of the post cut away to reveal the interior of the post with a counterweight mechanism.

Referring to FIG. 6, the preferred embodiment uses a constant force spring 87 as the counterweight mechanism to provide for nearly effortless movement of the homogenizing unit 59 up and down post 64. Unit 59 normally weighs 10 pounds. Bracket 89 slides up and down post 64. A clamping mechanism (not shown) is provided to secure bracket 89 at a desired vertical position on post 64. The clamping mechanism is operated by means of a knob 68. When knob 68 is operated to loosen the clamping mechanism, bracket 89 is free to move up and down post 64. The constant force spring 87, an item well known in the art, is a thin flexible band of metal with a permanent curvature along its entire length. The curvature and tensile strength of the spring 87 is such that, at its rest position, it is a tightly coiled bundle. When the spring 87 is stretched out, along any portion of its length, it exerts a constant force until it is returned to its coiled position. Spring 87 thus provides an upwardly directed force on bracket 89. The size and curvature of spring 87 is chosen to substantially balance the downward force on bracket 89 caused by the weight of the homogenizing unit 59. The constant force spring 87 is attached to and wound onto spool 88. Spool 88, located at the top of the interior of post 64, is attached at its ends by bearings or other means to allow it to rotate freely. The end of the constant force spring, which is not attached to spool 88, is attached to the bracket 89 at the end of arm 91 of the bracket. There is a long thin slot 90 running up and down post 64. Slot 90 allows the free passage, up and down the post 64, of the arm 91 connecting the constant force spring 87 to bracket 89. Thus, an operator of the homogenizing unit can move the homogenizing unit 59 up and down post 64 with little or no effort.

Figure 2:
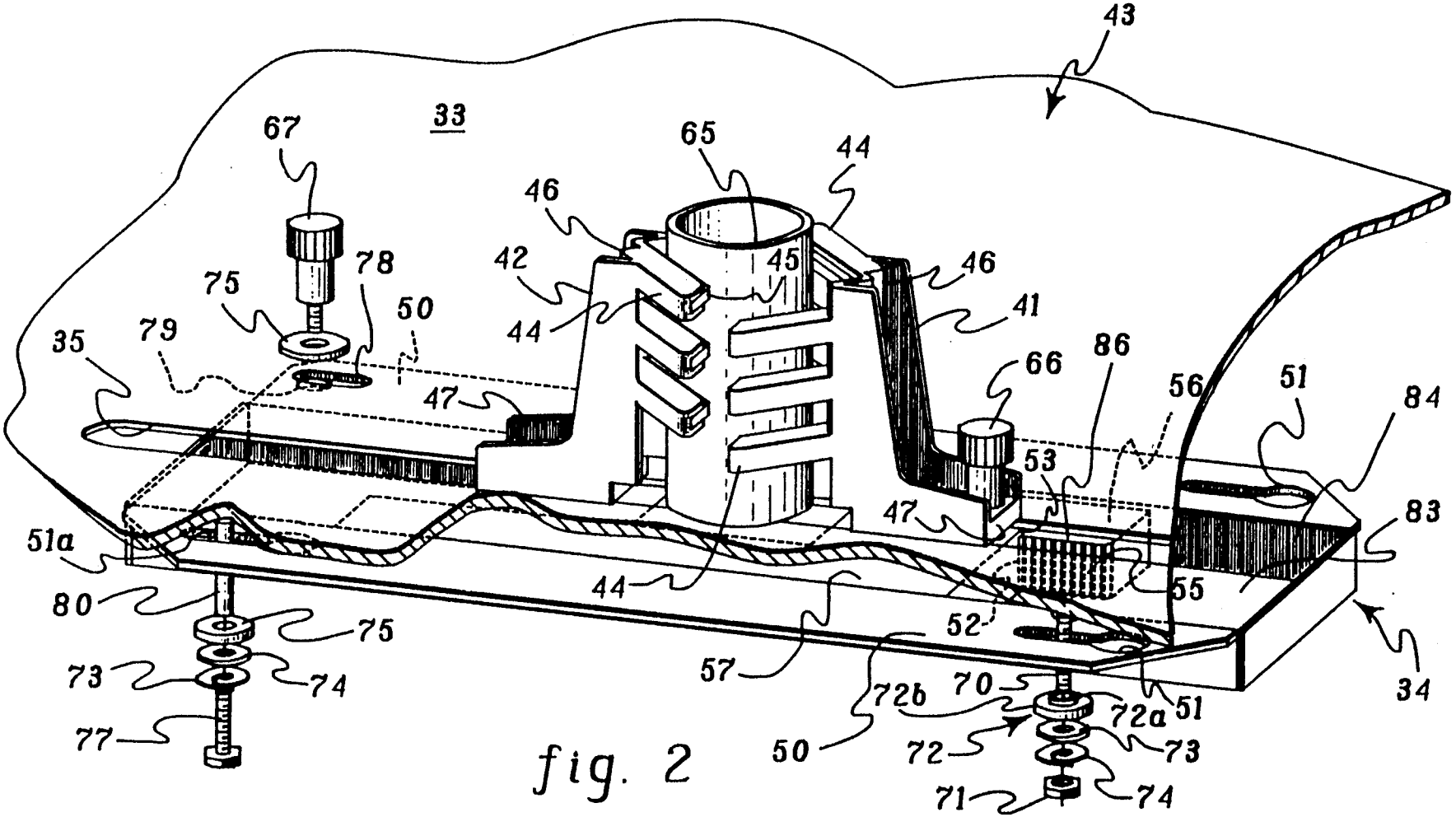
FIG. 2 is a fragmentary view of the homogenizer of FIG. 1 showing the clamping assembly, as well as portions of a gear box, and details concerning the attachment of the gear box to the base of the homogenizer.
Figure 3A:
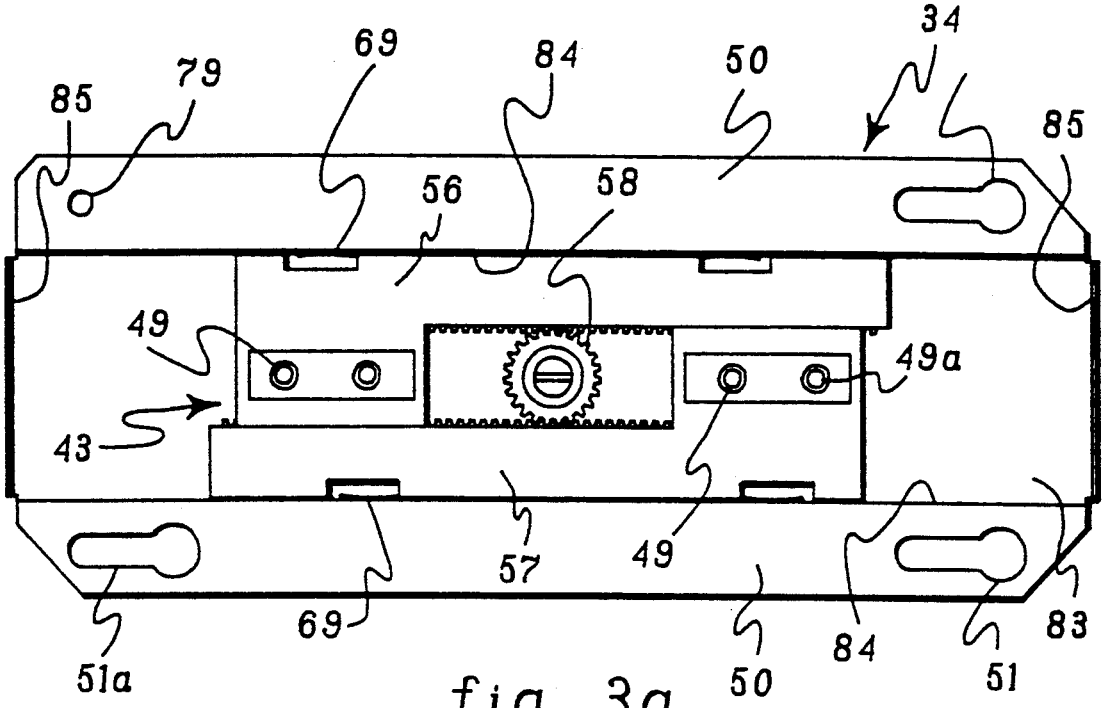
FIG. 3A is overview of the gear box and the rack and pinion mechanism extended to a partially open position.

Referring to FIG. 1 again, a gripping and holding means or, as it will be called herein, the clamping assembly 43 securely holds the flask 65 with the material to be homogenized. The clamping assembly 43, in part, consists of a first grip 41 and a second grip 42. Referring to FIG. 1 and FIG. 2, grip 41 is attached to rack 57 located below the base plate 33 and grip 42 is attached to rack 56, also located below the base plate 33. Both grip 41 and grip 42 are each attached to the respective racks 57 and 56 through base plate slot 35. Base plate slot 35 is an opening in base plate 33. As is best shown in FIG. 2 and FIG. 3A, racks 57 and 56, together with pinion 58 located between them, are part of the clamping assembly 43 and rest in a gear box 34, also known as a rack subassembly housing.

Referring to FIG. 1 again, knob 66 is used as a handle to open and close the clamping assembly 43. When knob 66 is pulled away from grip 42, both grips move apart from each other by the same distance; likewise, when knob 66 is pushed towards grip 42, both grips move towards each other by the same distance. Consequently, by separating grip 41 and grip 42 with knob 66, flask 65 can be set between grip 41 and grip 42. Then, by pushing knob 66 towards grip 42, the two grips can be brought in contact with flask 65 to secure and hold it. The mechanism that causes the grips 41 and 42 to move apart or together in unison is the rack and pinion assembly discussed above.

Figure 3B:
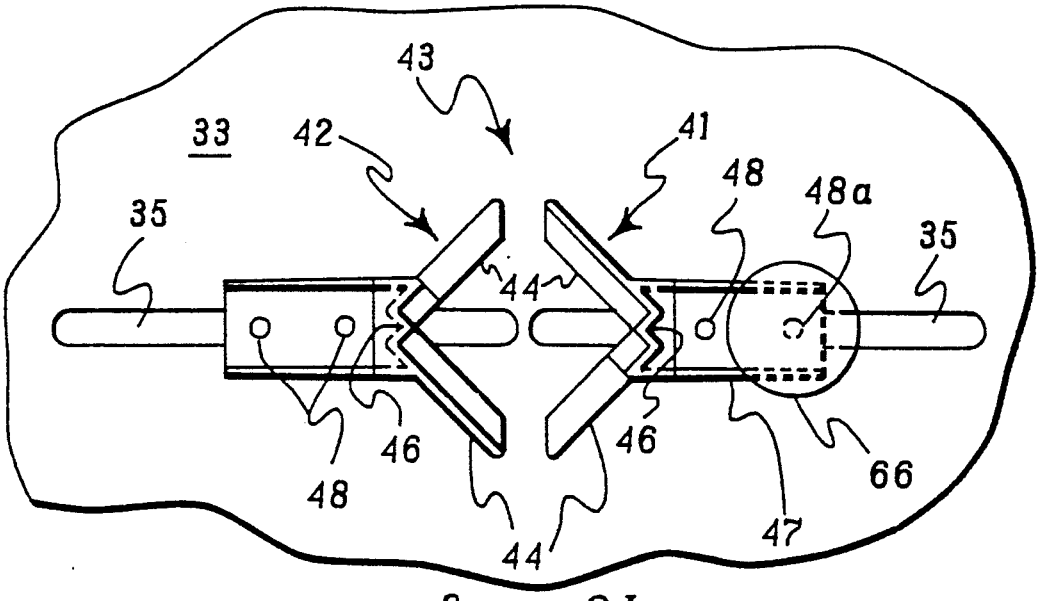
FIG. 3B depicts the two grips of the clamping assembly in their relative position when the rack and pinion mechanism is extended as shown in FIG. 3A.

Knob 66 can also be tightened to prevent movement of the clamping assembly 43 when desired. Referring to FIGS. 3A and 3B, knob 66 is mounted on a threaded shaft which projects down through a hole 48A in a foot 47 of grip 41 and a threaded hole 49A in rack 57. Hole 49A goes all the way through rack 57 to the bottom of the gear box 34. When knob 66 is tightened, it exerts pressure on the bottom of the gear box 34 and prevents movement. Loosening knob 66 moves it out of contact with the bottom of the gear box 34 and allows movement of the grips 41 and 42.

In FIG. 1 and FIG. 2 it will be noted grip 41 and grip 42 have fingers 44 that make up part of the gripping structure. Additionally, as best seen in FIG. 2, along the inside surface of each finger 44 which faces the opposite grip, there is a surface 45 made of rubber or of a similar elastic and pliable material that comes in contact with the container 65 and helps to hold container 65.

Knob 67, FIG. 1 and FIG. 2, when tightened, secures the gear box 34 securely to base plate 33. When knob 67 is loosened, it allows for movement of the gear box 34 and the clamping assembly 43 contained therein, and thus, movement of the flask 65 so that the flask 65 can be centered or decentered with respect to the shaft and homogenizing tool 60 when desired. More detail concerning this aspect of the present invention will be provided below.

FIG. 2 depicts the clamping assembly 43 located in the gear box 34. A cut away portion of the base plate 33 is depicted, with the base plate slot 35 thereon. Gear box 34 looks like a tray with a depressed area 83 making up a substantial portion of its center. There are wings 50 coming off of the center portion of the gear box 34. The wings 50 are part of the means for securing the gear box 34 to the base plate 33. The wings 50 have slots 51 and 51A thereon, as well as threaded screw hole 79. More concerning these features will be stated below.

FIG. 3A depicts the gear box 34 and the bottom portion of the clamping assembly 43 about midway between a fully closed and fully open position. The bottom portion of the clamping assembly 43, as noted above, is made up of rack 56, rack 57 and pinion 58 located between them. Each rack 56 and 57 is an "L" shaped structure with a set of teeth located along an inside portion of the rack that mesh with the teeth of the pinion 58. Each rack at one end has a wider portion which contains holes 49 for screws. Rack 57 also has hole 49A for knob 66. Each rack, on the side opposite the teeth have two springs 69 which come in contact with the walls 84 of the depression 83 of the gear box 34 and provide sufficient tension to force each rack against the pinion 58. The pinion 58 and racks 56 and 57 are constructed such that when one rack is moved, the other rack moves in the opposite direction. The longitudinal movement of each of the racks 56 and 57 is stopped by the pinion 58 in one direction and by the ends 85 of the gear box 34 in the other direction.

FIG. 3B depicts the upper portion of the clamping assembly 43, grips 41 and 42, which, as shown in FIG. 1 and FIG. 2, extend above base plate 33 out of base plate slot 35. In the foot 47 of each grip are holes 48 for the insertion of screws. The holes 48 of each grip 41 and 42 line up with the screw holes 49 in each rack 56 and 57 of FIG. 3A and provide the means for connecting the grips to the racks. As noted above, knob 66 is screwed into the outside hole 48A on foot 47 of grip 41. The grips in FIG. 3B are in the same position they would be in if they were attached to the racks in FIG. 3A.

Referring to FIG. 2, a space 52 exists between rack 56 and 57. Also, a ridge 53 of rack 57 abuts against a smooth surface 86 on rack 56. This allows the teeth 55 of rack 56 to pass and not contact rack 57. A corresponding structure (not shown) is provided on rack 56 to allow the unimpeded passage of the teeth 55 of rack 57.

The grips in the preferred embodiment have a "V" shape when viewed from above as depicted in FIG. 2 and FIG. 3B. There is a center spine 46 from which two banks of fingers 44 project at an angle.

Both grips 41 and 42 are identical to each other. Referring to FIG. 2, the fingers 44 on each side of spine 46 of the grips are offset so that, in effect, when grips 41 and 42 face each other and are brought close together by pushing knob 66 towards grip 42, the fingers 44 of each grip will become interleaved such that the fingers 44 of grip 41 will pass in between the fingers 44 of grip 42. Consequently, the grips can be brought together and hold securely containers or vessels of very small size.

One of the advantages of the present invention is the ability to center and decenter the container 65 with respect to the homogenizing tool. As noted above, vortexing is a common problem well known to those familiar with the art. One way to reduce or avoid vortexing is to decenter the container holding the item to be homogenized. In the present invention, the homogenizing unit 59 and the shaft and homogenizing tool 60, FIG. 1, can only be moved in one dimension, either up or down. They are held above the same spot on base plate 33. However, the clamping assembly 43, which holds container 65, can be easily centered or decentered when necessary.

Gear box 34 and clamping assembly 43, which rests in the gear box 34, can be centered under the homogenizing tool 60 or decentered because of the way gear box 34 is attached to the base plate 33. The gear box 34 connects to the base plate 33 at four points located on the wings 50 of the gear box. As shown in FIG. 2, key hole shaped slots 51 in gear box 34 are two of the points where the gear box 34 connects to the base plate 33. FIG. 2 gives an exploded view of the mechanism holding the gear box 34 at slots 51. This mechanism is made up of a threaded stud 70, shoulder washer 72, flat washer 73, lock washer 74 and hexnut 71. Stud 70 is welded to the bottom of the base plate 33. Stud 70 projects down through slot 51 in the gear box 34. Shoulder washer 72 is placed over stud 70. The neck **72*a* of shoulder washer 72 projects up through slot 51 of the gear box 34. The wider portion 72*b* of the shoulder washer 72 rest against the bottom of the gear box 34. A flat washer 73 sits next to the shoulder washer 72. Up against the flat washer 73 is a lock washer 74 and finally a hexnut 71 threads onto the stud 70 to hold all the items in place. The length or height of neck 72A of the shoulder washer 72 is slightly greater than the thickness of wing 50, thus allowing for movement of the gear box 34 since the gear box is not pressed tightly against base plate 33. The neck 72A of the shoulder washer 72 fits snugly into slots 51 and will only allow movement at that point along slot 51 in a direction parallel to base plate slot 35**.

The third point at which the gear box 34 is attached to the base plate 33 is at slot 51A. FIG. 2 has an exploded view of the mechanism holding the gear box 34 at slot 51A. The mechanism is made up of a hollow stud 80, thrust washer 75, flat washer 74, lock washer 73 and screw 77. The hollow stud 80 with a threaded interior is welded onto the bottom of the base plate 33. The hollow stud 80 projects down through slot 51A. Thrust washer 75 fits over stud 80. Flat washer 74 rests against the end of stud 80 and, in turn, lock washer 73 rests against flat washer 74. Screw 77 threads into the hollow stud 80 to hold the gear box and washers in place. The diameter of the interior hole of flat washer 74 is smaller than the exterior diameter of stud 80. Thus, flat washer 74 does not rest against thrust washer 75, but rather the end of the stud 80. Flat washer 74 then provides a firm base against which screw 77 can force lock washer 73 and provide a secure connection, while at the same time, allow for free movement of the gear box about slot 51A since there is no force against thrust washer 75.

The fourth point at which the gear box 34 is connected to the base plate 33 is at threaded hole 79 on the gear box 34. FIG. 2 depicts an exploded view of a mechanism which holds the gear box 34 at threaded hole 79. The mechanism is made up of a knob 67, thrust washer 75, elliptical hole 78 in base plate 33 and threaded hole 79 in wing 50 of the gear box 34. Locking knob 67 projects down through the elliptical slot 78 in base plate 33 and threads into threaded hole 79 of the gear box 34. Between the knob 67 and the base plate 33 with its elliptical hole 78 is thrust washer 75 to prevent the knob 67 from falling into the slot 78.

Consequently, when knob 67 is loosened, the gear box 34 and the clamping assembly 43 can be moved along the length of slots 51, 51A on the gear box and slot 78 of the base plate. This movement is generally parallel with base plate slot 35 or in a longitudinal direction. Likewise, the gear box 34 and the clamping assembly 43, which sits in the gear box 34, can be prevented from moving by tightening knob 67.

The shaft of knob 67 which projects through slot 78 is smaller in diameter than the width of slot 78, likewise, hollow stud 80 is smaller in diameter than slot 51A. Consequently, since neither has a shoulder washer surrounding them, they are free to move in a direction perpendicular to base plate slot 35. The movement would only be slight, say about one-eighth of an inch, but it would be sufficient to correct for situations where the homogenizing tool does not properly line up with a small container, such as test tube, and some adjustment is necessary in the direction perpendicular to base plate slot 35 to properly center the test tube.

Figure 4:
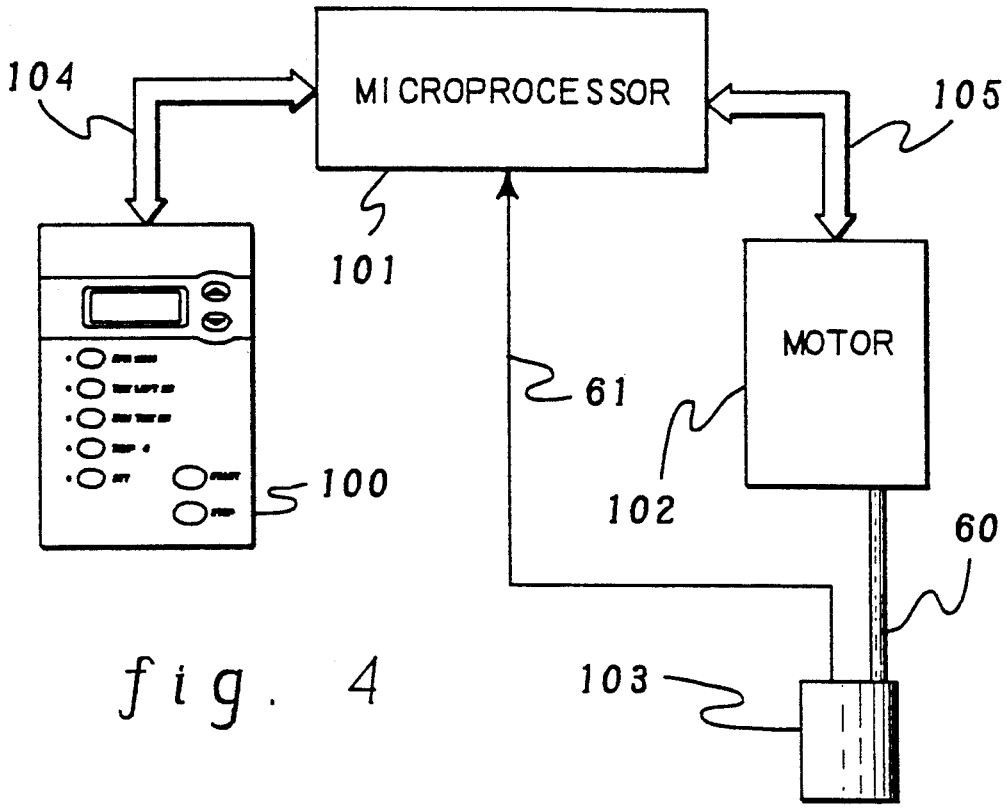
FIG. 4 is a block diagram of the electronic control unit and its electrical connection to other parts of the system.

The electronic control system of the present invention will now be described. FIG. 4 presents an overall view of the electronic control system in the form of a block diagram. The microprocessor 101 is at the heart of the system and controls all of the functions of the system. Membrane panel 100 programs the microprocessor 101 and provides, during the homogenization process, readings of: a) the temperature of the sample, b) the time left before the process ends, c) the time elapsed since commencement of the process and d) the speed of the motor in revolutions per minute, RPM's. BUS 104 is the electronic link between the membrane panel 100 and the microprocessor 101.. The microprocessor 101 receives programing instructions from the panel 100 over BUS 104 and sends readings to the panel 100 over BUS 104.

Control line 105 is the electronic link between the motor 102 and the microprocessor 101. Over line 105 the microprocessor 101 controls the speed and time of an operation of the motor 102 and monitors the speed of the motor 102. Motor 102 is, in turn, connected to the shaft and homogenizing tool 60 to which the motor 102 provides power.

The microprocessor 101, FIG. 4, monitors the temperature of the sample being homogenized in container 103. This is accomplished by means of a temperature sensor 61 which provides to the microprocessor 101 temperature readings of the sample being homogenized. The temperature sensor can be a thermocouple, a resistive temperature device or any other appropriate device which can be used to sense temperature. The microprocessor can also be programmed to shut the motor 102 off during the process of homogenization if the sample in container 103 rises to a preset temperature.

Figure 5:
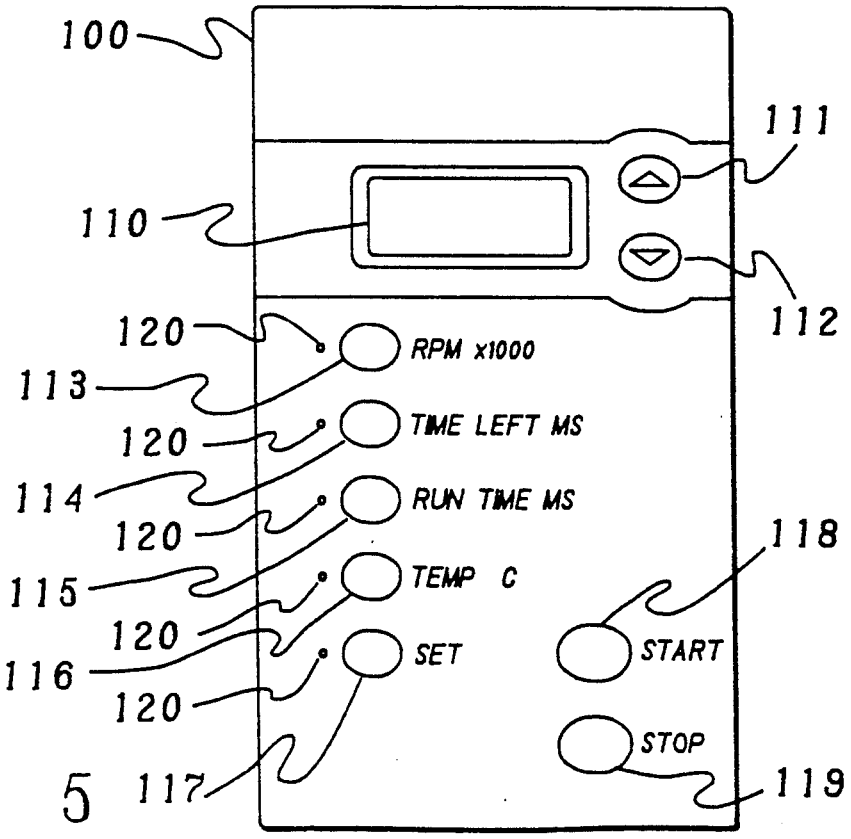
FIG. 5 is an enlarged view of the electronic membrane control panel.

In the preferred embodiment of the present invention panel 100 is the means for the operator to interface with and control the operation of the microprocessor and, in turn, the homogenizing unit 59, FIG. 1. Control panel 100, FIG. 5, may be a thin membrane panel. FIG. 5 depicts the control panel 100 in detail. There is a display screen 110 which may be a liquid crystal display or any number of small electronic display screens well known in the art. On FIG. 5 there is a start button 118 to commence the operation of the homogenizing unit and there is a stop button 119 to halt the operation of the homogenizing unit.

FIG. 5 shows seven (7) additional control buttons for programming the unit to obtain specific operating results. The set button 117 is provided for activating the programming features of the unit. To program the unit for operation, the operator would first push the set button 117 to activate the programming features. When the set button 117 is pushed, the adjacent LED light 120 would go on to indicate the unit is ready to be programmed. The operator can then select a programming feature by pushing: a) button 113 to set the speed, b) button 114 to set the total time for operation, or c) button 116 to set the temperature at which the homogenizing tool would shut-off if a specific temperature for the sample is not to be exceeded. When one of these buttons is pushed, the adjacent LED 120 goes on to indicate that function is activated.

Once the specific programming feature is selected, the setting of the numerical value for the speed, run time or temperature is accomplished by pressing buttons 111 or 112. Button 111 is used to raise the numerical figure which appears on screen 110 to the value desired. Button 112 would be used to lower the numerical figure which appears on screen 110 to the value desired. Once the processor is completely programmed, the set button 117 is again pushed, its LED 120 accordingly goes off, and the machine is ready to commence operation. However, the machine could be left in the set mode and still operate. Obviously, the container 65, FIG. 1, with the sample must be placed in the grips 41 and 42 and the rotatable homogenizing tool 60 lowered into the sample before the start button 118, FIG. 5, is pressed.

During operation of the homogenizer, the operator can monitor: a) the temperature by pressing the temperature button 116, b) the speed by pressing the RPM button 113, c) the time left in the process by pressing the time left button 114, and d) the time elapsed in the operation by pressing the run time button 115. The set button 117 must be off to monitor these parameter during operation.

During the operation of the homogenizer while it is still running, the operator can display and/or reset the parameters of operation such as the speed, duration of operation or temperature. All the operator must do is turn on the set button 117, then proceed to operate the display features and program the processor in the normal fashion, if a change in the parameters of operation is desired.

If the operator wants to stop the operation of the homogenizing process with the option of restarting it at the point that it was halted, the operator would push "stop" button 119 once. Pushing the start button 118 once would restart the homogenization process at the point it stopped in the preset parameters. If the operator would rather continue operation with the parameters at the value they were at when originally programmed the "stop" button 119 would be pushed twice. Finally, if the operator wanted to reset the parameters with the machine stopped, he would merely stop operation by pushing stop button 119 and go through the procedure as enumerated above for programming the processor.

The homogenizer will cease operation upon expiration of the time the homogenizer was set to run and LED 120 adjacent to the Time Left button 114 will start blinking. The operator then pushes the stop button 119 once to stop LED 120 from blinking. The original parameters programmed by the operator will remain in the memory of the processor. Consequently, operation of the homogenizers can be commenced again with the original programmed parameters by pressing Start button 118.

If, during the operation of the homogenizer, the temperature of the sample rises above the programmed temperature, operation of the homogenizer will cease and LED 120 adjacent to the temperature button 116 will start blinking. The operator pushes the stop button 119 once to stop the LED from blinking. If the temperature of the sample falls below the programmed temperature, operation can be recommenced at the point the homogenizer ceased operation in the present parameters. However, if the sample remains at the set temperature of higher the unit cannot be cleared or restarted. In this event, the temperature monitor must be disconnected or the temperature reprogrammed to a higher temperature to recommence operation.

A description of the microprocessor, thermocouple and construction of the thin membrane panel will not be given since they are well known in the art. Also, programming the microprocessor to provide the functions and modes of operation described above are well known in the art.

While the invention has been particularly shown and described with reference to a preferred embodiment thereof, it will be understood by those skilled in the art that various changes in form and detail may be made therein without departing from the spirit and scope of the invention.

We claim:

1. A homogenizer suitable for homogenizing material in a container, the homogenizer comprising:

a substantially horizontal base, said base having a first slot therein and a second slot therein;

a substantially vertical post connected to the base;

a motor mounted to the post so that said motor can be moved and positioned vertically;

a rotatable homogenizing tool connected to the motor and depending therefrom;

means supported by the base for gripping a container and holding a container under the rotatable homogenizing tool, wherein said gripping and holding means is adjustable to grip and hold containers of variable size, and wherein said gripping and holding means is positioned over said first slot of said base and comprises a first grip member and a second grip member with further means to simultaneously move the first grip member and the second grip member in equal and opposite directions along said first slot of said base so that the grip members selectively hold or release any object therebetween; and a gear box movably mounted beneath said base for centering and decentering said gripping and holding means with respect to said homogenizing tool, said gripping and holding means connected to said gear box by a knob extending from said gripping and holding means through said first slot in said base to said gear box, said gear box having an aperture therein, and said gear box mounted to said base by a locking knob extending through said second slot in said base and through said aperture in said gear box, said locking knob securely fitting within said aperture and movable within said second slot, so that when said locking knob is slid in said second slot of said base, said gear box moves, thereby moving said gripping and holding means connected thereto so as to center and decenter said gripping and holding means with respect to said homogenizing tool.

2. The homogenizer of claim 1 wherein said means to simultaneously move the grip members in equal but opposite directions is a rack and pinion assembly with the first grip attached to a first rack of the assembly and the second grip attached to a second rack of the assembly.

3. The homogenizer of claim 2 wherein said rack and pinion assembly are contained in said gear box mounted beneath the base and the grip members are connected to the racks through said first slot in the base.

4. The homogenizer of claim 1 comprising further means to monitor the temperature of a sample being homogenized and means to stop the process of homogenization if the sample reaches a predetermined temperature.

5. The homogenizer of claim 1 further comprising a microprocessor for controlling operation of said homogenizer.

6. The homogenizer of claim 5 further comprising means to program the microprocessor.

7. The homogenizer of claim 6 further comprising means to monitor the temperature of the sample being homogenized.

8. The homogenizer of claim 7 wherein the programming means includes means for setting a predetermined temperature, wherein said microprocessor terminates operations of said homogenizer when the temperature of the material being homogenized equals the predetermined temperature.

9. The homogenizer of claim 8 wherein the means to monitor the temperature of the sample being homogenized is a thermocouple.

10. The homogenizer of claim 8 wherein the means to monitor the temperature of the sample being homogenized is a resistance temperature device.

11. The homogenizer of claim 5 wherein the microprocessor may be programmed to control the speed and time of operation of the motor and homogenizing tool.

12. The homogenizer of claim 1 comprising further means for counterweighting the homogenizing motor and tool for ease of movement of the motor and tool up and down the vertical post.

13. The homogenizer of claim 12 wherein the means for counterweighting comprises a constant force spring.

14. The homogenizer of claim 12 wherein the vertical post is hollow and contains the means for counterweighting.

* * * * *